US006067993A

United States Patent [19]

Mahoney, III

[11] Patent Number: 6,067,993

[45] Date of Patent: May 30, 2000

[54] FILTER ADAPTER FOR USE WITH SMOKING APPARATUS

[76] Inventor: Thomas P. Mahoney, III, 32 Atwood Ave., Sausalito, Calif. 94965

[21] Appl. No.: 09/204,657

[22] Filed: Dec. 2, 1998

[51] Int. Cl.[7] ..... A24F 1/14; A24F 1/20; A24F 1/16; A24F 1/02; A24D 1/04

[52] U.S. Cl. ..... 131/173; 131/200; 131/202; 131/201; 131/207; 131/210; 131/212.2; 131/215.3; 131/215.1

[58] Field of Search ..... 131/173, 200, 131/202, 201, 207, 210, 212.2, 215.1, 215.3, 338, 341

[56] References Cited

U.S. PATENT DOCUMENTS

| | | | |
|---|---|---|---|
| 3,308,224 | 3/1967 | Waddington et al. | 264/242 |
| 4,036,240 | 7/1977 | Murray | 131/173 |
| 4,096,868 | 6/1978 | Norman | 131/173 |
| 4,216,785 | 8/1980 | Erikson et al. | 131/173 |
| 4,357,948 | 11/1982 | Schweitzer | 131/173 |
| 4,517,989 | 5/1985 | Mensik | 131/187 |
| 4,648,410 | 3/1987 | Seroussi | 131/173 |
| 4,682,610 | 7/1987 | Freelain | 131/173 |
| 5,476,110 | 12/1995 | Baig | 131/173 |

OTHER PUBLICATIONS

Web Page (see attached), Jan. 1999, Denicotea.

*Primary Examiner*—James Derrington
*Assistant Examiner*—Dionne A. Walls
*Attorney, Agent, or Firm*—David Pressman

[57] ABSTRACT

A filter adapter for use with a waterpipe comprises a closure cap with a cutout; a spigot tap with a cylindrical sleeve, an integral port, a cylindrical base with male threads, the port providing communication between the sleeve and the base; and a ventilated filter cartridge containing a filter medium, preferably silica gel granules. The closure cap is frictionally engaged over the smoke passage of the waterpipe. The spigot tap, having been threaded into the cutout of the closure cap, effects the seal between the spigot tap and the smoke passage. The diameter of the sleeve on the spigot tap is a predetermined diameter to allow frictional insertion of a filter cartridge. A ventilated filter cartridge preferably containing silica gel granules as a filtering medium is frictionally engaged into the open end of the sleeve. The spigot tap provides communication between the filter cartridge and the smoke passage. In the second embodiment, the closure cap has a cutout with a predetermined diameter to fit a compressible bushing with an axial bore. The bore is a predetermined diameter to provide frictional engagement of a hollow tube with a sleeve insert. The sleeve insert has a predetermined diameter to frictionally engage a ventilated filter cartridge filled with a filter medium, preferably silica gel granules. In both embodiments, the user inhales smoke which is drawn through a passage containing water and ice. The filter cartridge purifies smoke consumed from the smokable substance, resulting in the users' experience being more pleasant, satisfying and beneficial.

7 Claims, 3 Drawing Sheets

Figure 1:
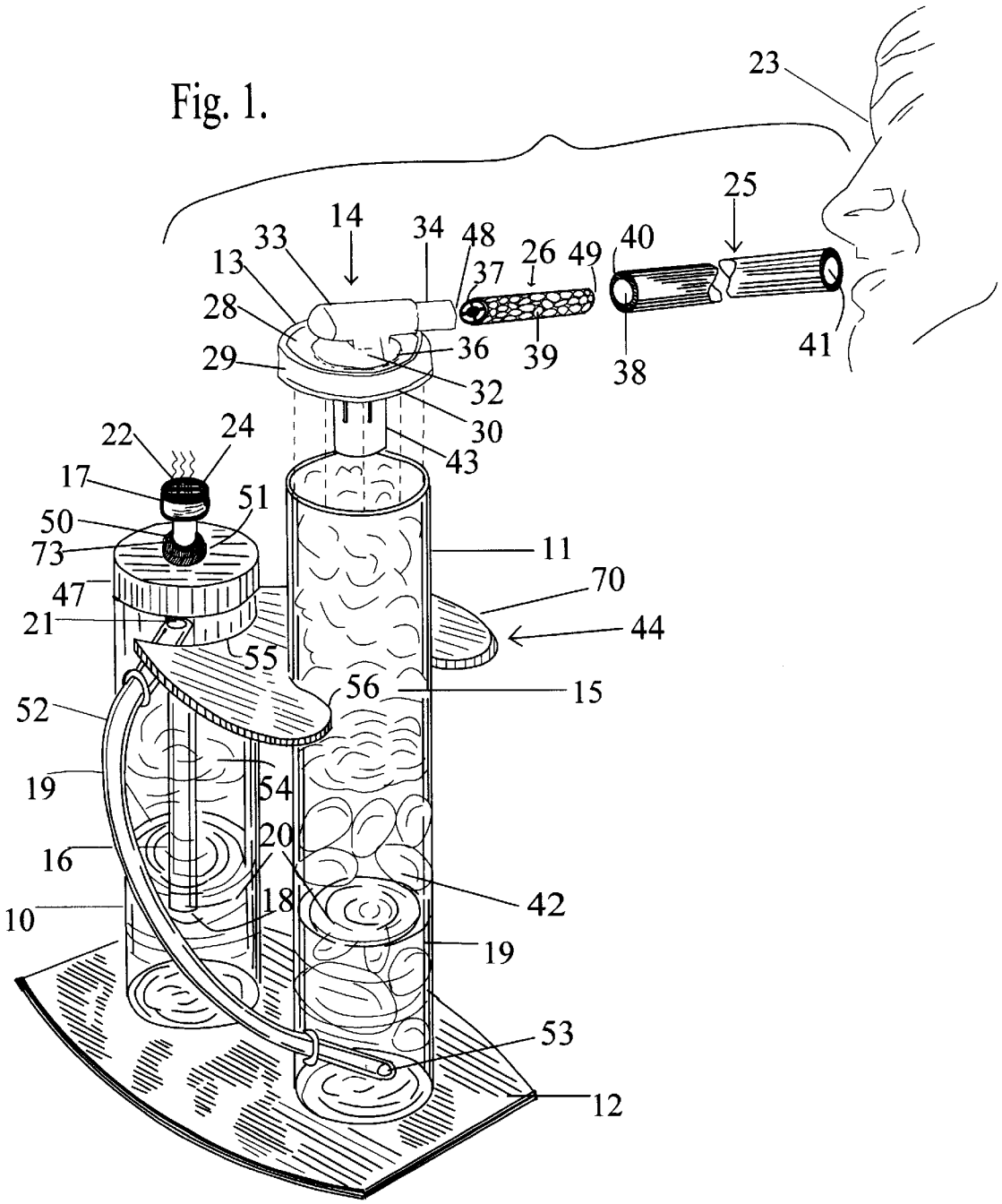

14
33
34
37
26
49
25
41
28
13
48
39
40
38
29
36
30
32

36
31
32
33
34
48

33
34
48
36
32
31

27
28
13
30
29

33
32
35
34
48

46
43

FILTER ADAPTER FOR USE WITH SMOKING APPARATUS

BACKGROUND

1. Field of the Invention

This invention relates to devices or apparatus for filtering and cooling smoke. In particular, it relates to a filtering apparatus that can be mounted on various water-cooled pipes thus providing a more pleasing and healthier experience for a smoker.

2. Description of Prior Art

For many years the dangers of smoking have been acknowledged. Smoking causes emphysema, bronchitis, and heart disease. Despite many differences between the substances that people smoke, one thing they all have in common is tar. Tar is the black sludge in smoke that, when deposited in the lungs, causes damage to the lung cavities, narrowing the airways, stimulating the production of excess mucous, and destroying microscopic hairs that keep harmful airborne materials out of the lungs.

By cooling and filtering smoke from burning leaves (tobacco, herbs, etc.) before inhalation, various smoking devices have utilized water as a cooling and filtering medium. For several hundreds of years waterpipes, also known as hookahs, bongs, and bubblers, have been used to smoke various kinds of leaves. The purpose of a waterpipe is to cause the smoke to travel or bubble through water, thereby cooling, purifying, and reducing the harshness of the smoke, thus making it less irritating to the smoker. Generally, using a smoking apparatus that is equipped with a water chamber has always been considered one of the safest and best ways to cleanse smoke of impurities.

Material that is smoked with an apparatus hereinafter will be referred to as a "smokeable substance". This may comprise tobacco, corn, silk, medicinal herbs such as marijuana or anything that may be burned and inhaled into just the mouth. A smokeable substance can provide a variety of tastes and aromas. Any smoking apparatus that has a cylindrical chamber for filtering smoke through water hereinafter is referred to as a waterpipe.

Many waterpipe users smoke therapeutic substances such as marijuana for medicinal purposes. Since many waterpipe users suffer from illnesses and conditions that have compromised their immune systems, they can be at a greater risk for contracting serious respiratory ailments. Some use a waterpipe to insure that the smoke is reasonably cleansed of contaminants that might trigger or aggravate their respiratory condition. When the impurities are removed, smoke is less damaging when inhaled than smoke which is untreated.

During the past 130 years, little progress has been made to develop a practical and widely accepted smoke filtration system that can be used to boost a waterpipes capability. Many prior-art devices have modified waterpipes in an effort to increase their acceptance in the United States or other Western countries. However, most of the modified waterpipes on the market typically have not gained wide acceptance because they fail to provide a practical tar removal device that can be used with the various types of waterpipes currently used. At present, there is no filtration adapter that has the ability to be used with a wide variety of pipe designs, sizes and configurations. The waterpipes currently on the market do not provide users with a device that has an opening where a cartridge containing filtration media may be inserted. Also, for a filter medium to be acceptable in the market, it must be effective at tar removal, convenient, easy to use and inexpensive.

The smoking apparatus currently used provide different methods of filtering the toxins from smoke that is inhaled. For example, Freelain describes "an open top bottle pipe designed to utilize a liquid in a liquid chamber of the bottle to cool smoke". Within the liquid are "pieces", like "gravel, rocks, stones or sand" which have a "density greater than the liquid". These are used in combination with other pieces that "have a density less than the liquid" like "wood or plastic, such as pieces of cork or plastic caps from small non-refillable pens". These pieces which are "present in the smoke chamber" during use are supposed to "create a tortuous path for the smoke to travel through the liquid". The filtration media described in the Freelain patent has an obscure nature and must be assembled and placed into the device by the user. This design is complicated, difficult to use, and has never gained wide acceptance. Another reason may be because the filter medium becomes soiled, and needs to be handled by the user in order for it to be replaced. Additionally, it appears that no post-bubbler filtration occurs outside of the main chamber. All the inadequacies of this device make it unacceptable to those users who are looking for a simple solution to filtering smoke through a liquid. (U.S. Pat. No. 4,682,610 to Freelain, Jul. 28, 1987).

In U.S. Pat. No. 4,648,410 Seroussi, Mar. 10, 1987, a smoking apparatus with a "groove means" is described as engaging with a "jar" that has "grooves along its upper rim". Designed to remove "excess moisture" from "cured tobaccos", the filtration medium is described as "absorbent filtrous material such as rolled paper". This apparatus supposedly "permits the user to control and manage the smoking activity, using cured tobaccos which are packaged and readily available in the market place". To use this apparatus, the smoker must acquire and prepare the filter media for use. After the filter medium is gathered, it likely should not be stored where it may be contaminated by moisture, since the stated intention of the device is to collect the moisture present in the smoke. After the filter media is ready, the user must fill the filter element, then seal the element with the cap provided. A "tubular passage in the form of a flexible conduit" needs to be inserted in the cap that encloses the filter element so that the smoker can draw from it. This "flexible conduit can be several feet in length". A small tube attached to the main body of the apparatus supports the filter element, cap and the flexible conduit. Given its small size and yet substantial importance to the overall stability of the device, the weight of the cap and flexible conduit could cause the small tube to fail and the entire apparatus could then topple. Also in respect to the small tube, because of its size and inaccessibility, it is difficult for the user to clean it. Before this device can be operated, the user must first acquire, store and then assemble the filter media. At some point after loading the filter media into the element and operating the device, the user should remove the soiled filter material and dispose of it.

U.S. Pat. No. 4,036,240 Murray, Jul. 19, 1977, describes a replaceable post-bubbler filtering cartridge that is only used with liquid. The "filtering" cartridge is changeable and houses the liquid. However, no post-bubbler filtration device is provided. Because this complicated device can basically only be used to provide liquid filtration and is not adaptable to other smoking apparatus, usage is very limited.

There are many 'after-market' filtration systems available to cigarette smokers. Most of which involve a cigarette holder and do not use water. One exception is U.S. Pat. No 5,476,110 to Baig, Dec. 19, 1995, which describes a cigarette holder with a water-chamber but no bubbler. Aside from the water in the chamber and a filter that could be part of a cigarette, it does not appear to have additional filtration provided. One drawback to this device is that all filtration occurs before the smoke is drawn into the water chamber and not after.

The use of ventilated tubes that are filled with silica gel granules to filter nicotine and tar from tobacco smoke in cigarettes has been known for some while. One notable example of a system that uses these granules to filter cigarette smoke has been available for use with a special holder, since the early 1930s, under the trademark DENICOTEA by Alfred Dunhill of London. Silica gel granules have also been used because of their desiccant (moisture absorbing) characteristics. These non-toxic granules are often found in small packets that are provided in packaging for new products, such as leather goods that are sensitive to humid or moist air. However, the level of performance of the DENICOTEA cigarette filter tube is inadequate when the filters are used in the method prescribed by the manufacturer. The filters are primarily only designed for insertion into a specially designed cigarette holder. The package instructions state that the filters should be discarded after "the granules have turned amber or dark". However, when the filters are used with the recommended holder in this way, the amount of tar removed from the smoke is less than substantial. Since tar has a sticky and viscous nature, the simple act of discoloring the granules is little if any proof that a significant reduction of tar has actually taken place. Also, because the filter tubes used with this system are only to be used with a special cigarette holder that lacks both provisions to use it with water or post-bubbler capabilities, there is no easy way for this system to be used with a waterpipe.

Aside from the fact that they all use water, most waterpipes used today have one other thing in common. They have a main smoke passage in the form of a cylinder or tube which serves three purposes; 1) it provides a water chamber to wash the smoke, 2) it provides a smoke holding chamber, and 3) it provides a combination mouthpiece and inhalation conduit for the smoker. The typical size of the cylinder is about 5 cm. in diameter. Ice can be placed in and above the water in the cylinder to cool the smoke as it passes through the water.

U.S. Pat. No. 4,096,868 to Norman, Jun. 27, 1978, discloses putting ice cubes in the main chamber of a waterpipe to cool the smoke. This device may provide a more pleasing smoking experience, but it typically fails to remove impurities after the smoke bubbles through the water and before it is inhaled. Airborne impurities and tar may still be present in the smoke.

Other examples of this type of waterpipe are shown in U.S. Pat No. 4,216,785 to Erickson & Jarvie, Aug. 12, 1980, and U.S. Pat. No. 4,357,948 to Schweitzer, Nov. 9, 1982. Here again, even though both apparatuses utilize the cleaning abilities of water or water and ice together, airborne impurities and tar may still be present in the smoke. All these devices lack a means to filter the smoke, other than water. In addition, sometimes the actual manner of use with this kind of smoking apparatus can be awkward and unsafe. In use, the smoker typically needs to open the mouth wide in order to position it over the end of the smoke passage. Then, while igniting the smokeable substance, draw out the smoke. This approach may require the smoker to directly face the flame when lighting the substance. Erickson & Jarvie illustrates an example of this approach.

In addition to these shortcomings, the devices of the above Freelain and Seroussi patents typically do not enable multiple smokers to have their own mouthpiece for insertion into the pipe. There are people who suffer from various conditions and find that their health can be improved by smoking medicinal herbs. But, since many of these people also have compromised immune systems, they can be at risk for contracting an infection that could come after sharing a waterpipe that may have someone else's microorganisms on the mouthpiece.

In many examples of the waterpipes found, none provide a substantially easy-to-use and effective solution to filtering smoke. Nor do any of the systems available to cigarette smokers provide a system of this type. It appears that all of the attempts at filtering smoke with or without water suffer from at least one of the following disadvantages:

a) They fail to provide a substantial reduction of the impurities present in smoke consumed from a smoking apparatus that uses water.

b) None of the smoking apparatus that use water also have an opening for frictional engagement of a replaceable filter cartridge.

c) In the devices of the above Seroussi and Murray patents, the filters appear complex and would require specially designed pipes. It's difficult to see how they could provide adequate filtration so as to be able to work reliably and effectively. These devices appear deficient, in spite of employing a whole array of very involved, difficult-to-manufacture and assemble parts that are arranged in a very precise and complicated manner. Despite all these complex arrangements, none gained wide acceptance, or seem to be particularly effective at cooling and purifying the smoke for inhalation by a smoker.

d) The systems may be difficult to clean because of their numerous parts and their complex design.

e) None of the patented devices above appear to have any provision for allowing multiple users to share the same inhalation port.

f) If the user of any waterpipe with a tubular smoke passage is in position with mouth open over the tubular passage, it can be uncomfortable and dangerous to face the source of ignition when the waterpipe is being lit.

Prior apparatus for filtering smoke with water typically have not provided a simple, convenient, easy-to-change or effective means of filtering smoke. It also seems unlikely that any of these devices could be easily adapted for use with any other smoking apparatus that use water.

It has been said that the smallest particles that are carried in smoke are sometimes not unleashed into smoke until the later stages of burning a smokeable substance. At this stage in the process, smoke can be bitter and harsh. A smoker that prefers to primarily use a conventional pipe (one that does not use water) might also want to see an improvement in their level of satisfaction when they are smoking and reach the later stages of burning a smokeable substance. One way this could be done would be to use a waterpipe that is equipped with a filter adapter as well as the conventional pipe (that does not use water). A smoker subscribing to this belief would typically have the conventional pipe that they prefer to use a majority of the time, and then a waterpipe equipped with a filter adapter. Just before the substance being smoked reaches the point where it begins to get bitter and harsh, the smoker transfers the partially smoked substance from the conventional pipe, to the waterpipe equipped with a filter adapter. In this way the smoker consumes the majority of the substance in the manner preferred. When the supposedly harsh remainder is consumed in a waterpipe that is equipped with a filter adapter, it is less harsh and bitter. In this way, the user smokes the way they are accustomed to, and still is able to see an improvement over using just a standard pipe.

What the market is lacking is a device that can be easily adapted for use with a wide variety of smoking apparatus and one that can utilize a commonly available and replaceable filtration means.

OBJECTS AND ADVANTAGES

Accordingly, several objects and advantages of the invention are:

a) to provide an improvement in filtration apparatus that remove impurities from smoke which is consumed from a waterpipe, b) to provide a device which, can be used on a smoking apparatus that uses water and has an opening that allows for frictional insertion of a replaceable filter cartridge, c) to provide a smoking apparatus that incorporates readily available and easily assembled components in a simple design, and that works with a wide majority of smoking apparatus in use today, d) to provide a system that is both simple and easy to operate and clean, e) to provide an improvement in a community smoking apparatus, and f) to provide an improvement in the comfort and safety of operation of a smoking apparatus.

Further objects are to provide a new use for a liquid control spigot tap apparatus, as well as providing a new use for ventilated tubular cartridges that are used in conjunction with a smoking apparatus that uses water and ice. And to provide an improvement in the removal of impurities from smoke that passes through a tubular cartridge containing silica gel granules to be used with a smoking apparatus equipped with chambers for washing and cooling smoke.

Still further objects and advantages will become apparent in consideration of the ensuing description and drawings.

DRAWING FIGURES

Figures 2A, 2B, 2C, 2D, 2E, 2F:
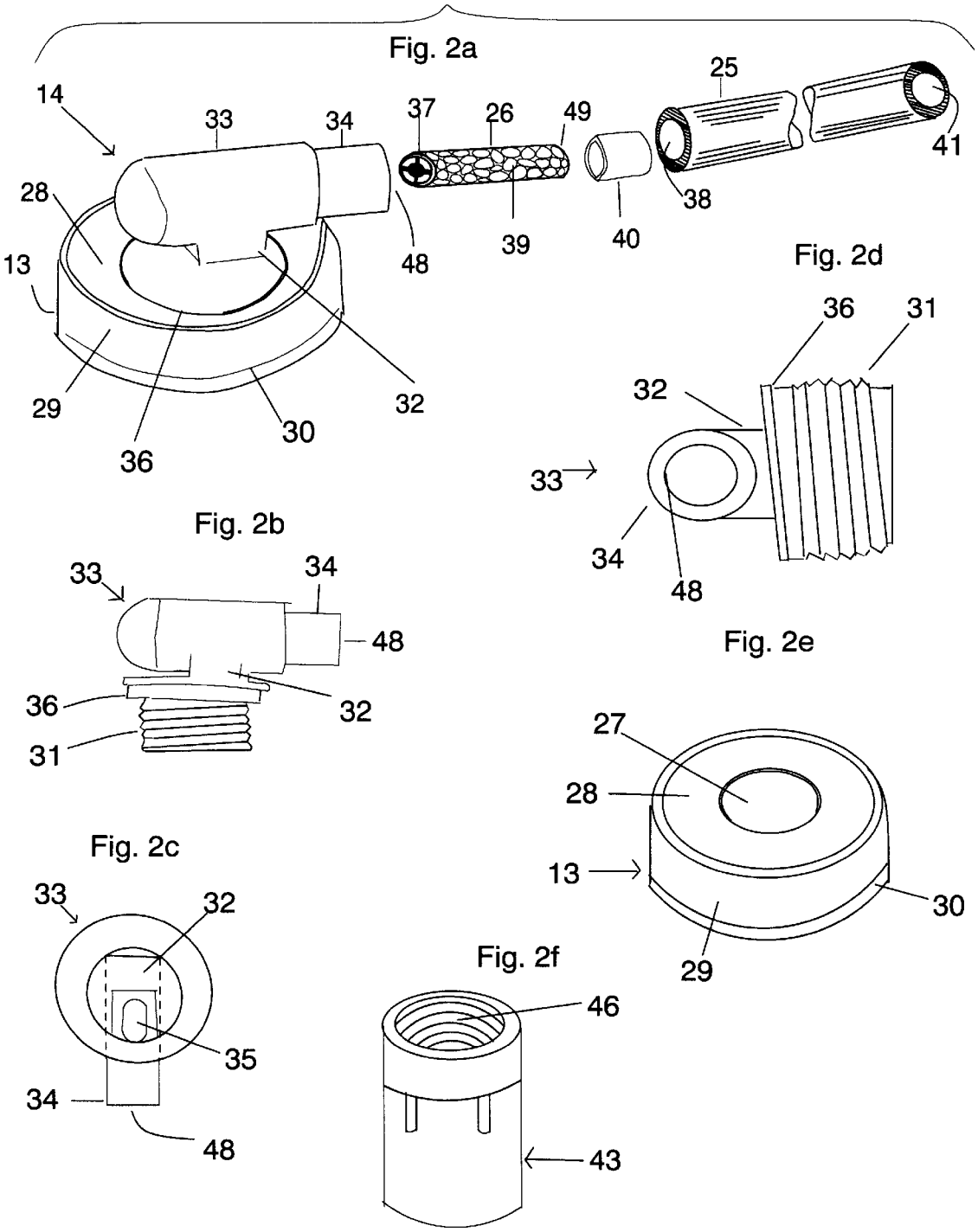

FIG. 1 is a perspective view of a first embodiment of the apparatus mounted on a two-chamber waterpipe FIG. 2*a* is an exploded view of the separate components of an apparatus of the type shown in FIG. 1.

FIG. 2*b* is a side view of a spigot tap of the apparatus of FIG. 1.

FIG. 2*c* is an underside view of the inside of a spigot tap of the apparatus of FIG. 1., showing an oval port.

FIG. 2*d* is a front view of a spigot tap of the apparatus of FIG. 1.

FIG. 2*e* is a perspective view of a closure cap with a cutout used in the apparatus in FIG. 1.

FIG. 2*f* is a perspective view of an arbor of the apparatus shown in FIG. 1.

Figure 3B:
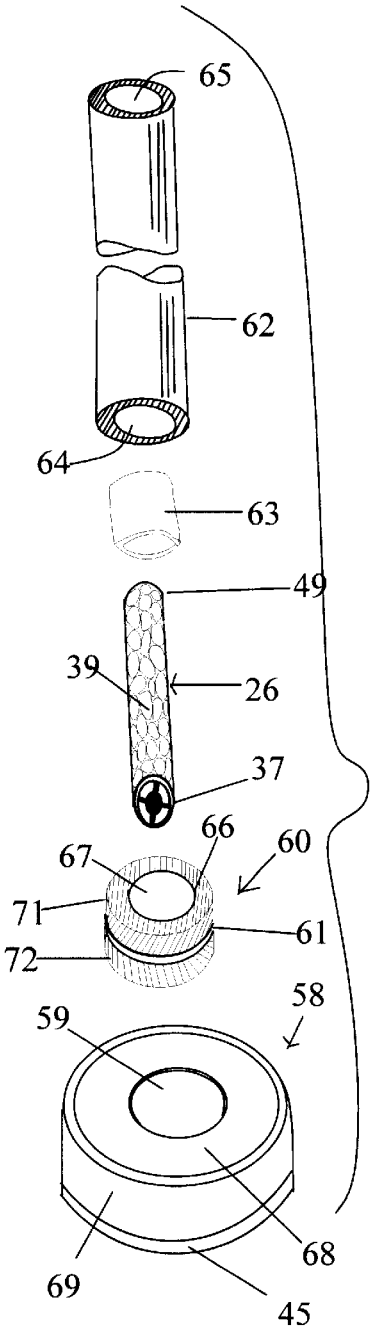
Figure 3A:
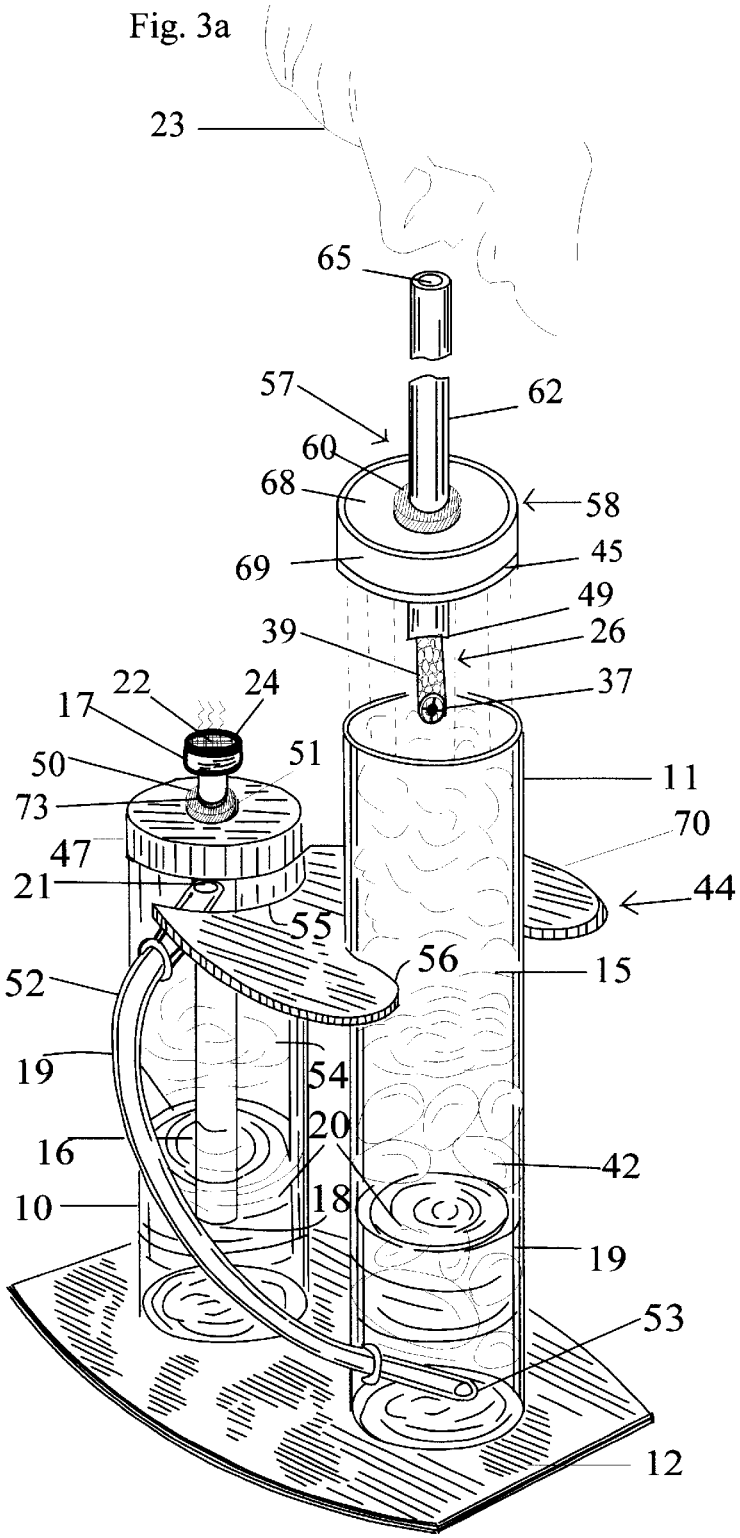

FIG. 3*a* is a representation of a waterpipe with a second embodiment of the apparatus ready to be mounted over a smoke passage.

FIG. 3*b* is an exploded view of the separate components of the apparatus of the type shown in FIG. 3*a*.

| REFERENCE NUMERALS IN DRAWINGS | |
|---|---|
| 10 | First cylinder |
| 11 | Second cylinder |

-continued

| REFERENCE NUMERALS IN DRAWINGS | |
|---|---|
| 12 | Base |
| 13 | Closure Cap |
| 14 | Filter adapter |
| 15 | Smoke Chamber |
| 16 | Smoke inlet tube |
| 17 | Combustion bowl |
| 18 | Tube opening |
| 19 | Water level |
| 20 | Liquid |
| 21 | Tubular aperture |
| 22 | Smokeable substance |
| 23 | Smoker |
| 24 | Brass screen member |
| 25 | Hollow tube |
| 26 | Filter cartridge |
| 27 | Circular cutout |
| 28 | Top wall |
| 29 | Depending skirt |
| 30 | Sealing bead |
| 31 | Cylindrical base |
| 32 | Hollow conduit |
| 33 | Spigot tap |
| 34 | Sleave |
| 35 | Oval port |
| 36 | Rubber gasket |
| 37 | Ventilated end cap |
| 38 | Open tubular end |
| 39 | Filter medium |
| 40 | Sleeve insert |
| 41 | Tubular end |
| 42 | Ice cubes |
| 43 | Arbor |
| 44 | Waterpipe |
| 45 | Annular sealing bead |
| 46 | Internal threads |
| 47 | Closure cap |
| 48 | Opening |
| 49 | End |
| 50 | Bushing |
| 51 | Axial bore |
| 52 | Hollow tube |
| 53 | Tubular aperture |
| 54 | Smoke chamber |
| 55 | Juncture |
| 56 | Juncture |
| 57 | 2nd embodiment-filter adapter |
| 58 | Closure Cap |
| 59 | Cutout |
| 60 | Bushing |
| 61 | Recessed groove |
| 62 | Hollow tube |
| 63 | Sleeve insert |
| 64 | Tube end |
| 65 | Tube end |
| 66 | Central cavity |
| 67 | Axial bore |
| 68 | Circular top wall |
| 69 | Depending skirt |
| 70 | Connecting member |
| 71 | Upper bushing element |
| 72 | Lower bushing element |
| 73 | Elastomeric ring |

SUMMARY

In accordance with the invention a filter adapter allows a smoker to enhance the experience of using an apparatus that has any number of cylindrical tubes with liquid for washing and cooling smoke. The device allows a replaceable filter cartridge containing a filter media to be used on such a passage. In addition to providing an improvement by filtering the smoke as it is drawn from the pipe, the device also permits the smoker to draw smoke from the pipe in a safer and more comfortable position.

The filter adapter combines three components: A conduit that is substantially hollow with an opening of a predetermined size to allow frictionally engagement of a replaceable tube containing a filtration media. The conduit is attached to a closure cap that is a predetermined diameter for enclosing the passage containing smoke.

The filter adapter utilizes the unique smoke cleansing qualities of disposable filter cartridges that contain silica gel desiccant. When used in conjunction with a smoking pipe that is equipped with chambers for washing and cooling the smoke, the filter cartridges exhibit substantial smoke purification characteristics.

DESCRIPTION

FIGS. 1 and 2*a* to 2*f*—FIRST EMBODIMENT

FIGS. 1 and 2*a* show an example of a first embodiment. The main difference between the first embodiment and the second is the direction from which the smoke is drawn out. With the first embodiment it is drawn out horizontally from the side (FIG. 1), and with the second (FIG. 3*a*) is drawn out vertically from the top. FIG. 1 shows an overall view of a smoker and a waterpipe mounted with a filter adapter according to the invention. A typical waterpipe usually has one or more chambers to cool and clean the smoke. Normally, if a waterpipe has more than one sealed chamber, flexible tubing connects the chambers together, thus permitting communication between them. The smoker provides suction while the smokeable substance is ignited, thus drawing the smoke from the combustion bowl into the sealed chamber(s) for cleansing before eventually reaching the smoker. Most waterpipes are designed for use on a flat sturdy surface, such as a table. If preferred, another suitable liquid, such as oil, a medicinal solution, etc., can be substituted for water.

In this first embodiment, a new filter cartridge 26 is in position and ready for use. Smoker 23 is in position and ready to ignite and draw smoke from a two-chamber waterpipe 44. Waterpipe 44 shown is comprised of first and second cylinders 10 and 11, which are disposed vertically upon a base 12.

Preferably cylinders 10 and 11 are made from acrylic. It is desirable and efficient to use cylindrical tubes to form the water and smoke containing chambers. One suitable diameter for cylinders 10 and 11 is 5 cm. A cylinder of such size will, within a manageable length of 30 to 35 cm., provide at least 10 to 15 cm. of water depth to sufficiently cool and purify the smoke. One of the two cylinders is for water and the other can be typically for water and ice. The bottom ends of cylinders 10 and 11 are rigidly bonded or otherwise secured to base 12. A connecting member 70 serves to stabilize first and second cylinders 10 and 11; it is bonded to the walls of cylinders 10 and 11 at junctures 55 and 56, respectively. Base 12 and connecting member 70 are preferably constructed from a flat piece of acrylic.

First cylinder 10 has frictionally engaged, over its end, a closure cap 47 with a cutout (not visible) and an axial bore 51 placed around the inside edge of the cutout. Smoke inlet tube 16, with combustion bowl 17 attached, has been inserted into axial bore 51. Tube 16 extends down into first cylinder 10, below the level of the water in cylinder 10. Cap 47 is made from a flexible thermoplastic material. Smoke inlet tube 16 is constructed from a heat-resistant metal alloy and has internal threads at the end where it is connected to combustion bowl 17. Tube 16 may have an interior passage in the neighborhood of 1 cm in diameter, or larger. A tube of such diameter does not offer any appreciable resistance to the suction provided when smoker 23 draws air into waterpipe 44.

Combustion bowl 17 has a smoke opening 4 to 5 mm in diameter. The size of this opening is smaller than the diameter of tube 16, which combustion bowl 17 communicates with. Combustion bowl 17 is typically constructed of brass or another suitable metal and has external threads (not visible), so that it can be threaded into smoke inlet tube 16.

A conventional circular stainless steel or brass screen member 24 serves as a filter and retaining means for a smokeable substance 22 within combustion bowl 17. An elastomeric ring 73 that has been frictionally engaged around the top portion of tube 16 serves to maintain an airtight seal within first cylinder 10 after tube 16 has been inserted and rests on top of axial bore 51.

First cylinder 10 is approximately half filled with water 20 to water level 19. Water level 19 should be lower than the level of tubular aperture 21 in order to prevent water 20 from escaping through aperture 21. Opening 18 at the bottom of smoke inlet tube 16 is positioned near the bottom of first cylinder 10, as shown, seeing that water level 19 reaches a level higher than opening 18 of tube 16. The air space between water level 19 and cap 47 constitutes a smoke chamber 54. A hollow tube 52 with tubular apertures 21 and 53 provides communication between smoke chamber 54 in first cylinder 10 and water 20 in second cylinder 11.

Second cylinder 11 is typically ⅓ filled with water 20 to water level 19. Ice cubes 42 are typically placed in cylinder 11, stacked to about 5 cm from the top. Smoke chamber 15 should be about 20–25 cm. in height. This provides a suitable volume of smoke for accommodating an average smoker 23.

Filter adapter 14 is frictionally engaged over the open end of second cylinder 11. Referring to FIGS. 1 and 2*a* to 2*f*, filter adapter 14 comprises the following components:

A) A closure cap 13 (FIGS. 2*e*) with a circular cutout 27. Cap 13 has a flat, resilient, circular top wall 28, and depending skirt 29 with an inwardly directed annular sealing bead 30. Cap 13 is molded of a suitable thermoplastic material, such as high-density polyethylene. Cap 13 includes a circular top wall 28 having a diameter that is determined by the outside diameter of second cylinder 11, which encloses it. Top wall 28 has a thickness proportional to its diameter, and is sufficiently resilient to flex. Circular cutout 27 is a predetermined diameter to be threaded over the external male threads of cylindrical base 31. One of the functions of cap 13 is to keep any residual smoke in smoke chamber 15 from escaping, between draws from waterpipe 44.

B) A spigot tap 33 (FIGS. 2*b*–2*d*). Tap 33 consists of a body part having a skirted hollow conduit 32 molded from low-density polyethylene, with an integral horizontal cylindrical sleeve 34, and a threaded vertical cylindrical base 31. Hollow conduit 32 provides a sealed compartment that permits communication between sleeve 34 and base 31, through oval port 35 (FIG. 2*c*). Oval port 35 could also be fashioned with a round or semicircular shape. Base 31 is substantially cylindrical and has external threads in its lower portion as rubber gasket 36 to ensure an air tight seal when spigot tap 33 is threaded through cutout 27 of cap 13. Tap 33 provides the following features and functions:

1) It provides a way to reduce or step down the wideness of the opening of second cylinder 11 on waterpipe 44,
2) It provides an opening 48 (FIG. 2*d*) for the frictional insertion of a replaceable filter cartridge 26,
3) It provides a way to redirect the flow of the smoke out the side of second cylinder 11 instead of from out of its top. This benefits smoker 23 by allowing the smoke to be drawn from a safer and more comfortable position, and 4) It provides an improvement in community smoking devices because it allows several users to smoke from the same waterpipe, without fear of coming into contact with microorganisms deposited on the mouthpiece from a previous user.

C) Filter cartridge 26 (FIG. 2*a*). Filter cartridge 26 is preferably a tube filled with granules approximately 9 mm in diameter and 3 cm in length, and with apertures for ventilation at both ends. Proximal end 49 has ventilation apertures in an end wall. The opposite, distal end has several ventilation apertures in an end cap 37, which is frictionally engaged over it. The end with ventilated end cap 37 is also the end frictionally engaged in sleeve 34 of spigot tap 33. Inside filter cartridge 26 are granules 39 that are sealed within by ventilated end cap 37. Granules 39 are silica gel of varying size and dimensions. The size and shape of the ventilation aperture's in the end wall and end cap 37 can vary, as long as sufficient airflow is provided and containment of the filtration medium is assured. Filter cartridge 26 is dimensioned and configured to fit within oval opening 48 of sleeve 34 of spigot tap 33. It also fits within sleeve insert 40 in hollow tube 25.

D) Hollow Tube 25 (FIG. 2*a*) Tube 25 comprises a hollow hose with a forward filter-receiving sleeve insert 40 and is open at both ends 41 and 38. Sleeve insert 40 has a predetermined diameter so that when it is inserted into an end 38, it forms a central cavity adapted towards providing frictional and releasable engagement of filter cartridge 26.

E) Arbor 43 (FIG. 2*f*). Arbor 43 consists of a hollow cylindrical portion with internal threads 46. Base 31 of tap 33 (FIG. 2*b*) is threaded through cutout 27 (FIG. 2*e*) of circular top wall 28 on closure cap 13. Base 31 is also threaded into internal threads 46 (FIG. 2*f*) of arbor 43. Once base 31 is frictionally engaged with arbor 43, top wall 28 rests snugly between base 31 and arbor 43. Sleeve 34 of tap 33 communicates with its base 31 via oval port 35.

Cap 13 is of an appropriate diameter so as to frictionally engage over the end of second cylinder 11, which houses water 20 and (possibly) ice cubes 42. Together, spigot tap 33 and closure cap 13 are frictionally engaged over the uppermost terminus of second cylinder 11.

In preparation for the smoker, proximal end 49 of filter cartridge 26 has been frictionally engaged into sleeve insert 40, which is inside end 38 of tube 25. Tube 25, with filter cartridge 26 in place, is then frictionally inserted into opening 48 of sleeve 34. Smokeable substance 22 is placed into combustion bowl 17.

Once filter cartridge 26 is frictionally engaged, the smoker is ready to ignite, and draw smoke from waterpipe 44. Waterpipe 44 is typically selected in size and proportion in accordance with the individual smoker's desires.

OPERATION OF FIRST EMBODIMENT

In two-chamber pipe 44 shown (which is preferred), the smoke is drawn into first cylinder 10 and cleansed by water 20, and then drawn again into second cylinder 11, where it is further cooled and filtered by water 20 and (possibly) ice 42.

To use waterpipe 44, smoker 23 applies a lighted match, lighter, or the like to smokeable substance 22 in combustion bowl 17 while drawing upon open end 41 of tube 25. Smoker 23 thus creates a partial vacuum in the air space above water 20 in second cylinder 11, i.e., in smoke chamber 15. The vacuum is communicated via tubes 52,16 and first cylinder 10 so as to cause air to be drawn into combustion bowl 17 at the same time as smokeable substance 22 is being ignited, thereby combusting substance 22. The resulting smoke is drawn down tube 16 and out of opening 18 into the lower portion of first cylinder 10, and bubbles up through water 20.

After the smoke bubbles through water 20 to the top of first cylinder 10 and into smoke chamber 54, it has been cleansed, cooled, and freed of much of the ash and other contaminants by its passage through water 20. Thereafter, it is drawn into tube 52, which leads to the bottom of second cylinder 11. The smoke enters water 20 and bubbles up through water 20 where it is further cooled and freed of any remaining ash and contaminants. With smoker 23 continuing to apply suction, the smoke is drawn through ice cubes 42 and streams into smoke chamber 15. The ice cools the smoke, causing the tar particles in the smoke to congeal and thicken, and adhere to those surfaces it may encounter more readily. This can also be accomplished without ice, by keeping the waterpipe in a refrigerator.

The smoke is then drawn into arbor 43. The smoke then proceeds into base 31 (FIG. 2*b*) of spigot tap 33, through oval port 35 (FIG. 2*c*), where its angle of flow is redirected, so that it comes out from the side of tap 33 through sleeve 34 (FIG. 2*b*). The smoke stream passes through ventilated end cap 37 and into the central inner chamber of filter cartridge 26, where it contacts solid filter material, i.e. granules 39.

As the smoke streams through filter cartridge 26, it hits the surfaces of granules 39, and accelerates to high speed as it flows through the restricted passages. The smoke impinges against the surfaces of granules 39 at varying angles and at high speed, and its direction of motion is substantially and abruptly altered. Any remaining heavier tar particles within the smoke stream, which have a substantial inertia relative to the air, are transported in the moisture-laden smoke vapor, which directly impinges against the outer surfaces of granules 39, causing it to stick to the granules. The smoke is thus purified of heavier tar particles, which typically remain stuck according to their stickiness and viscosity on the surfaces of granules 39.

The smoke then passes through tube 25 and end 41 to smoker 23. In this way, the smoke, in its journey from combustion bowl 17 to smoker 23 is substantially cooled and purified and generally made more pleasing in taste and less harsh. Depending upon the amount of substance 22 used, granules 39 in filter cartridge 26 will become contaminated with tar, resulting in filter cartridge 26 eventually becoming clogged. At this point drawing from the pipe becomes difficult. Still inserted in end 38 of tube 25, filter cartridge 26 is now frictionally disengaged from sleeve 34. Once removed, smoker 23 can conveniently disengage the used filter cartridge 26 from sleeve 40, and replace it with a fresh one.

FIGS. 3*a* and 3*b*—SECOND EMBODIMENT

A second embodiment is suitable for a user that prefers to draw smoke from a standing position instead of being seated next to the waterpipe. It could also be used for a waterpipe that has a main smoke chamber mounted on an angle.

The second embodiment would typically be used with the same kind waterpipe that is used with the first embodiment. Filter adapter 57 (FIG. 3*a*) attaches to the waterpipe in the same way, with the same type of closure cap. The diameter of cutout 59 on the second embodiment is smaller than cutout 27 on the first embodiment. This is because, instead of attaching a threaded spigot tap to the cutout as a conduit, bushing 60 has been compressed and then expanded around the inside of cutout 59 of cap 58. End 49 of filter cartridge 26 is inserted in end 64 of hollow tube 62, which is frictionally engaged as a unit through axial bore 67 of bushing 60.

Since bushing 60 is already in place around the inside of cutout 57 of cap 58, once tube 62 is engaged inside bushing 60, filter adapter 57 is complete. Filter adapter 57 can be used after it is frictionally engaged over the uppermost terminus of second cylinder 11.

Shown here, a smoker is in position and ready to ignite and draw smoke from a two-chamber waterpipe 44. In preparation, filter adapter 57 is frictionally engaged over the upper end of second cylinder 11, which also houses water 20 and (possibly) ice cubes 42.

FIG. 3*b* shows an exploded view of the second embodiment. In FIG. 3*a* filter adapter 57 is assembled and mounted on a two-chamber waterpipe. Filter adapter 57 comprises a closure cap 58 with a cutout 59. A cylindrical bushing 60 with axial bore 67 has been compressed and then expanded in order to fit around the inside of cutout 59 of cap 58. Hollow tube 62 has been frictionally engaged into axial bore 67. End 49 of filter cartridge 26 is frictionally engaged into sleeve insert 63 which has been inserted into end 64 of hollow tube 62. Filter adapter 57 is frictionally engaged over the end of second cylinder 11.

Filter adapter 57 comprises the following components:

A) Closure cap 58 with circular cutout 59 has a flat, resilient, circular top 68, and depending skirt 69 with an inwardly directed annular sealing bead 45. Cap 58 is molded of a suitable thermoplastic material, such as high-density polyethylene. Circular top wall 68 of cap 58 has a diameter, which is predetermined by the outside diameter of second cylinder 11, which it is to enclose. Top wall 68 has a thickness proportional to its diameter, and is sufficiently resilient to flex. The surface of top wall 68 has a circular cutout 59. Cutout 59 in cap 58 is of a predetermined diameter to form a seal with bushing 60 after bushing 60 has been expanded into place around the inside of cutout 59.

B) Bushing 60 is made of an elastomeric material, molded, and cylindrical, with an axial bore 67. It has upper and lower bushing elements, 71 and 72, which are substantially resilient and compressible. The space between upper bushing element 71 and lower bushing element 72 is a recessed groove 61. Recessed groove 61 traverses the circumference of the side of bushing 60, in a relative fixed position around cutout 59. Axial bore 67 has a predetermined diameter to form a central cavity 66, which can accommodate frictional engagement of hollow tube 62. Once hollow tube 62 is inserted into central cavity 66, an airtight seal is formed.

C) Hollow tube 62 comprises a tubular hose with a forward filter receiving sleeve insert 63, and is open at both ends 64 and 65. Sleeve insert 63 is inserted into end 64 in order to form a central cavity adapted to provide frictional and releasable engagement of filter cartridge 26.

D) Filter cartridge 26 is preferably a hollow cylindrical member approximately 9 mm in diameter, 3 cm in length, and has apertures for ventilation at both ends. Proximal end 49 has several ventilation apertures in an end wall. The opposite, distal end has several ventilation apertures in an end cap 37, which is frictionally engaged over it. Inside filter cartridge 26 are granules 39 that are sealed within by cap 37. Granules 39 are silica gel of varying size and dimensions. The size and shape of the ventilation aperture's in the end wall and end cap 37 can vary, as long as sufficient airflow is provided and containment of the filtration medium is assured. Filter cartridge 26 is dimensioned and configured to fit sleeve insert 63.

OPERATION OF SECOND EMBODIMENT

The second embodiment works in much the same way on a waterpipe of the same type shown with the first embodiment. Like filter adapter 14 (FIG. 1), filter adapter 57 (FIG. 3*a*) has a replaceable filter cartridge 26 inserted into sleeve 63 of hollow tube 62. Tube 62, with filter tube 26 inserted, is then inserted into filter adapter 57, which is in communication with the smoke passage. Just as with the first embodiment, after the smoke is drawn through filter cartridge 26, the heavier tar particles are substantially inclined to stick to the granules, after first being washed and cooled in the smoke passage(s). In FIG. 3*a,* the filtration in filter tube 26 occurs after the smoke is drawn from the waterpipes main smoke passage, which in this case is second cylinder 11. Eventually, it will become difficult to draw smoke since filter cartridge 26 will eventually become clogged with impurities. With filter cartridge 26 still inserted in sleeve 63, smoker 23 can disengage tube 62 from bushing 60, in order to conveniently remove filter cartridge 26 from sleeve 63 and replace it with a fresh one.

CONCLUSIONS, RAMIFICATIONS, SCOPE

It will be seen that the present filter adapter in conjunction with a filter cartridge makes using a waterpipe considerably less harmful. The first and second embodiments of this filter adapter make it possible to retrofit almost any waterpipe in use today into a smoke cleansing system. It becomes possible to not only cool and cleanse the smoke of ash and other contaminants, but also to enhance a waterpipe's ability to remove impurities from smoke. The filtration material acts to attract moisture in the vapor-laden smoke, as well as many impurities that are carried with it. This kind of filtering uses two media, i.e., liquid such as water and relatively varied filtering material, such as silica gel granules in a synergistic fashion. Because the smoke is first washed by the liquid in the chamber(s), it has become saturated with moisture, causing the more solid filter materials such as silica gel granules to attract the water vapor as well as the particles of tar that are carried in it. Both media simultaneously compliment and contrast with one another.

The filter adapter uses highly effective and easy-to-replace filter cartridges.

It improves the performance of a waterpipe that uses water and ice with silica-gel filled ventilated tubular cartridges.

All the parts are simple, inexpensive, and currently available.

It enhances the comfort of the user by changing the way the smoke is drawn from the pipe.

Multiple users can share the same waterpipe without having to use the same mouthpiece, simply by having each smoker use a separate inhalation tube. Each tube can have its own filter cartridge inserted so in order to share the same filter adapter, each user only needs to frictionally engage and remove their respective tube (with the cartridge inserted) to draw smoke from the filter adapter.

With either filter adapter 14 (FIG. 1) or 57 (FIG. 3*a*), a one-chamber waterpipe is sufficient to see improved effectiveness in filtration of smoke. A typical one-chamber waterpipe has a combined combustion bowl and tube assembly that is side mounted and at an angle to the base of the single smoke and water cylinder. The smoke stream is drawn into the lower portion of the single chamber, to be mixed with liquid (and possibly ice), in the same way as with the two-chamber method. Naturally, the only difference is that with a one-chamber system, the smoke comes into contact only one time with the liquid. Having just one chamber to remove ash, impurities and cool the smoke can suffice, but two chambers are preferred.

Although the above descriptions contain many specificities, these should not be construed as limiting the scope of the invention, but as merely illustrations of some of the preferred embodiments of this invention. Other embodiments and variations thereof are possible.

Filter adapter 14 can be constructed other ways. If a passage that contains smoke has internal threads, it is possible to thread the externally threaded spigot tap directly onto the open end of such a passage, thus eliminating the need for a closure cap. If a passage that contains smoke has external threads, it is possible to thread a closure cap with internal threads onto the top of it.

The size of the closure cap may vary, depending upon the size of the smoke passage it is meant to enclose. The size of the spigot tap and its respective components may vary, thus controlling the quantity of smoke consumed. A plurality of cutouts or a plurality of the filter adapters described may be used on one closure cap.

The sleeve of the spigot tap may have a handle that rotates the sleeve and its oval port from open to a closed position, thus controlling the flow of smoke and air. If a plurality of filter adapters with on/off valves is combined together on the same closure cap, it is possible for a plurality of users to draw smoke from the waterpipe simultaneously. And if only one user wishes to use the kind the device described above, every tube but the one in use can have its on/off valve(s) set in the off position.

In another embodiment the spigot tap may swivel, the angle of orientation of the sleeve changing from 90° to vertical (as in the second embodiment). Another variation of the filter cartridge might have the tube that is used to inhale from, combined with the filter cartridge as an integral unit.

The size of the filter cartridge is typically dependent on the size of the opening with which it frictionally engages on the filter adapter. Any of the component materials may vary, providing all substitute materials are able to allow the same substantial function to be addressed.

The embodiments shown are therefore to be considered illustrative and not restrictive. The scope of this invention is indicated by the claims and their legal equivalents rather than by this foregoing description.

I claim:

1. A method for removing impurities from a smokeable substance, comprising;

providing a cylindrical passage having a lower portion which can hold water and an upper part that holds air and has an open end, providing a combustion chamber for combustion of a smokeable substance, said combustion chamber being in fluid communication with said cylindrical passage, providing a closure cap with a cutout and a predetermined outside diameter corresponding to that of said passage, engaging said closure cap in releasable sealing attachment with said open end of said passage;

providing a spigot tap with a substantially cylindrical and threaded base, said spigot tap comprising a body part having a sleeve with a port that communicates with said base, said base engaged in sealing attachment with said cutout of said closure cap, providing a ventilated tubular filter cartridge containing a granulated filtering medium, said tubular filtering cartridge having a ventilated and releasable cap that prevents escape of said filtering medium, the distal end of said filter cartridge having a predetermined diameter so as to frictionally engage with said smaller diameter inside said sleeve of said spigot tap, and drawing smoke from said combustion chamber, through said passage, said spigot tap, and said proximal end of said ventilated filter cartridge, whereby said filter cartridge removes at least one impurity from said smokeable substance.

2. The method of claim 1 wherein said filter medium in said tubular filter cartridge comprises silica gel granules.

3. The method of claim 1, further including a hollow tube having one end connected to said proximal end of said filter cartridge.

4. A device for removing impurities from a smokeable substance when it is drawn through a cylindrical passage, comprising;

a cylindrical passage having a lower portion which can hold water and an upper part which holds air and has an open end, a combustion chamber for combustion of a smokeable substance, said combustion chamber being in fluid communication with said cylindrical passage, a closure cap for communication with said cylindrical passage, said closure cap having a top wall that has a circular cutout;

said closure cap including an annular sidewall which is substantially perpendicular to and is integrally formed with and depends from said top wall, said closure cap having a predetermined outside diameter corresponding to that of said cylindrical passage, said annular sidewall including an inside surface which mates with said cylindrical passage, said closure cap engaged in releasable sealing attachment with said open end of said passage, a spigot tap for communication with said cylindrical passage, said spigot tap having a substantially cylindrical and threaded base, said spigot tap comprising a body part having a sleeve with a port that communicates with said base, said base engaged in sealing attachment with said cutout of said closure cap, said sleeve of said spigot tap having a smaller diameter around the circumference of its interior closest to said body part and a ventilated tubular filter cartridge containing a granulated filtering medium; the distal end of said tubular filter cartridge having a ventilated and releasable cap that prevents escape of said filtering medium, said tubular cartridge having a predetermined diameter so as to frictionally engage with said sleeve, whereby said filter cartridge removes at least one impurity from said smokeable substance.

5. The device of claim 4 wherein said filter medium in said tubular filter cartridge comprises silica gel granules.

6. The device of claim 4, further including a hollow tube having one end connected to said proximal end of said filter cartridge; said hollow tube including means for enabling said filter cartridge to be frictionally engaged with said hollow tube.

7. The device of claim 4, wherein said spigot tap is formed of thermoplastic material.

* * * * *